US006082872A

United States Patent [19]

Ting

[11] Patent Number: 6,082,872

[45] Date of Patent: Jul. 4, 2000

[54] INDICATING DEVICE FASTENABLE BY MEANS OF A FASTENING BAND

[76] Inventor: Wu-Hsiung Ting, 65, Lane 30, Lo Li Third St., An Lo Dist., Keelung, Taiwan

[21] Appl. No.: 09/044,141

[22] Filed: Mar. 19, 1998

[51] Int. Cl.[7] ..... F21L 7/00

[52] U.S. Cl. ..... 362/205; 362/191; 362/394

[58] Field of Search ..... 362/103, 109, 362/119, 120, 190, 191, 202, 205, 259, 368, 394

[56] References Cited

U.S. PATENT DOCUMENTS

| | | | |
|---|---|---|---|
| 1,330,974 | 2/1920 | Bauman | 362/191 |
| 1,865,127 | 1/1932 | McKeen | 362/110 |
| 5,124,892 | 6/1992 | Lambert | 362/103 |

FOREIGN PATENT DOCUMENTS

| | | | |
|---|---|---|---|
| 1514969 | 1/1968 | France | 362/205 |
| 457264 | 11/1936 | United Kingdom | 362/205 |
| 562680 | 7/1944 | United Kingdom | 362/205 |

*Primary Examiner*—Sandra O'Shea
*Assistant Examiner*—Peggy C. Neils
*Attorney, Agent, or Firm*—Rabin & Champagne, P.C.

[57] ABSTRACT

An indicating device fastenable using a fastening band includes a housing, a light source mount having a light source module secured at a front end of the housing; a rear cover fitted at a rear end of the housing; a reset spring secured in the housing using a spindle screw and a nut; a metallic movable shaft mount, the reset spring having an outer end positioned at a lower end of the movable shaft mount; an electrically conductive spring secured at a central portion at the other end of the movable shaft mount, and a rotary shaft mount having a lower end disposed in an annular groove at an outer side of the movable shaft mount. The rotary shaft mount is internally provided with a battery chamber adapted to receive two batteries, one end of the batteries pressing against the electrically conductive spring with the other end resting against a positive conductive plate of the light source module entering from a through hole in front. The rotary shaft mount has a fastening band passing through a through hole of the housing to the outer side. The fastening band has a metallic fastening plate at a front end thereof. The fastening band is wound around an object to be secured with the fastening plate inserted via a conductive plate groove to be engaged in a reduced portion of a fastening slot of the housing such that the fastening plate is in contact with the metallic movable shaft mount and the conductive plate in the conductive plate groove of the housing, thereby electrically connecting the light source module to achieve illumination or indicating a target object.

3 Claims, 6 Drawing Sheets

INDICATING DEVICE FASTENABLE BY MEANS OF A FASTENING BAND

BACKGROUND OF THE INVENTION (a) Field of the Invention

The present invention relates generally to an indicating device fastenable by a fastening band, and more particularly to an indicating device which may be wound around an object such as a hand tool to serve as a light source or which may utilize a laser light source to indicate a target.

(b) Description of the Prior Art

Flashlights and laser indicators may be used for illumination and indications purposes. On a construction site where electricity is not connected, the workers may need to hold a flashlight in one hand and hold a hand tool in another hand when working in a dark place, which is very inconvenient. When holding a laser indicator to indicate a target during briefing or on a construction site, the laser indicator may slip out of the hand and be damaged. Besides, it is uncomfortable to hold the laser indicator in the hand for a long period of time. It is desirable to have an economical device which may be fastened to the hand or an object such as a hand tool to illuminate or indicate a target.

SUMMARY OF THE INVENTION

A primary object of the present invention is to provide an indicating device fastenable by means of a fastening band, in which the fastening band is wound around the outer circumference of a housing of the indicating device so that the indicating device may be fastened to an object for illumination or indication purposes and have wide applications.

Another object of the present invention is to provide an indicating device fastenable by means of a fastening band, in which the fastening band is provided with a scale or graduations to enhance the added value of a commodity.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
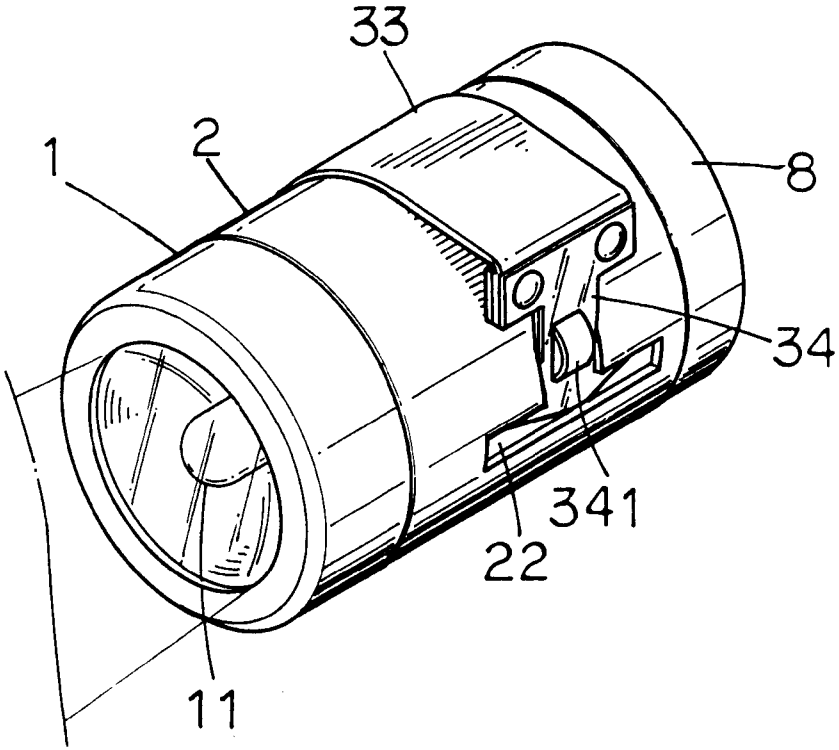
FIG. 1 is a perspective elevation of the present invention.
Figure 2:
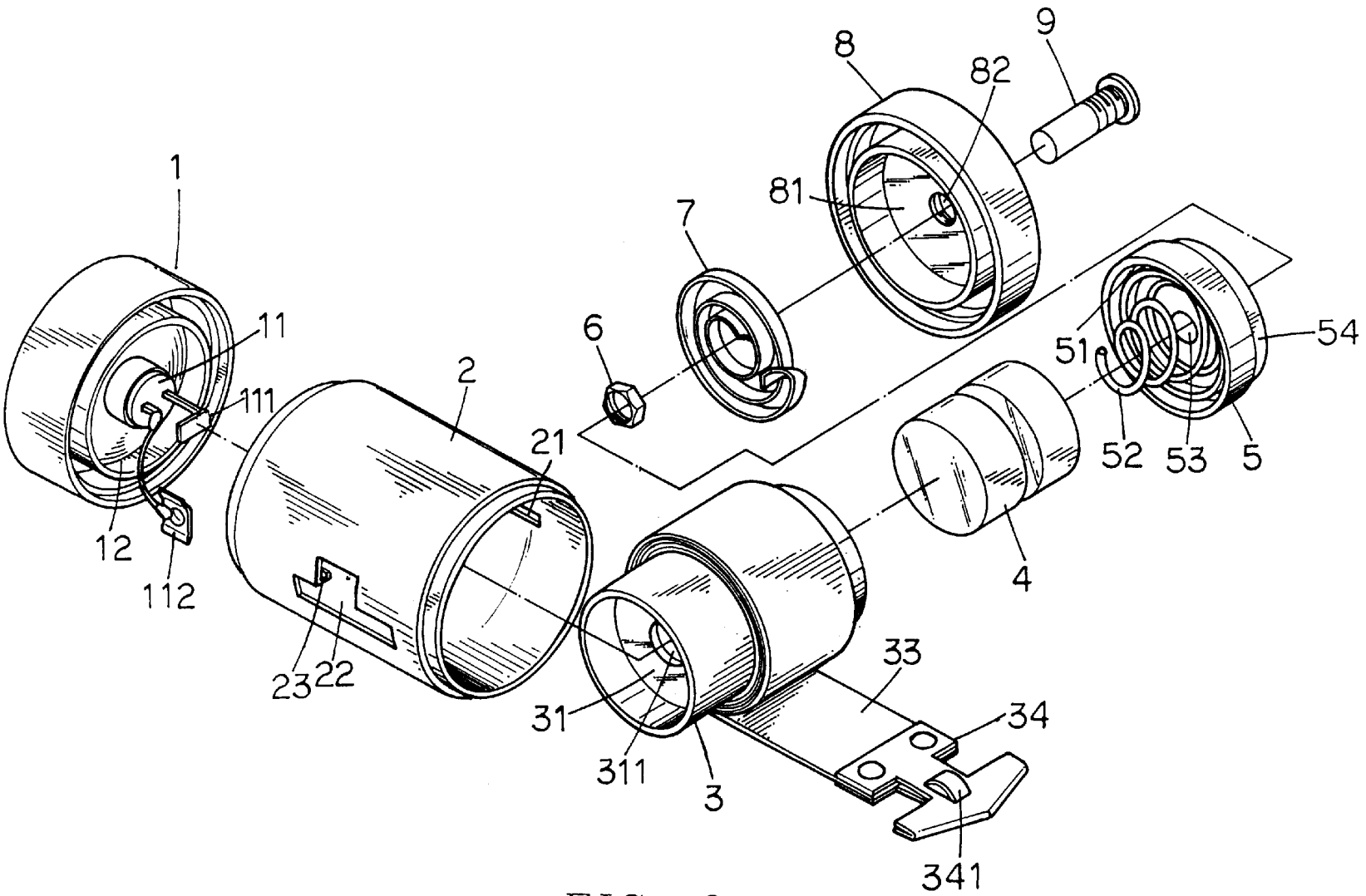
FIG. 2 is an exploded perspective view of the present invention.

With reference to FIGS. 1 and 2, which are perspective and exploded views of the present invention respectively, the present invention is substantially a cylindrical structure and comprises a light source mount 1, a housing 2, a rotary shaft mount 3, a battery 4, a movable shaft mount 5, a nut 6, a reset spring 7, a rear cover 8 and a spindle screw 9.

The light source mount 1 is a seat structure accommodating therein a light source module 11, with a positive conductive plate 111 and a negative conductive plate 112 disposed at a rear end thereof. An outer side of the light source mount 1 is provide with a shaft recess 12 for receiving one end of the rotary shaft mount 3 therein. The light source module 11 may be any lighting element such as an ordinary light bulb or diode or may be replaced by a laser diode module including a focusing lens, a laser diode and a circuit module, which will not be described in detail hereinafter. The present invention will be described in detail with reference to the light source module 11 in general.

The housing 2 is a hollow cylindrical structure having an elongate slot 21 formed at one side of its surrounding wall, and a fastening slot 22 formed at an opposite side. The fastening slot 22 has a reduced portion provided with a conductive plate securing groove 23 at one side for receiving the negative conductive plate 112 extended from the light source module 11.

Figure 3:
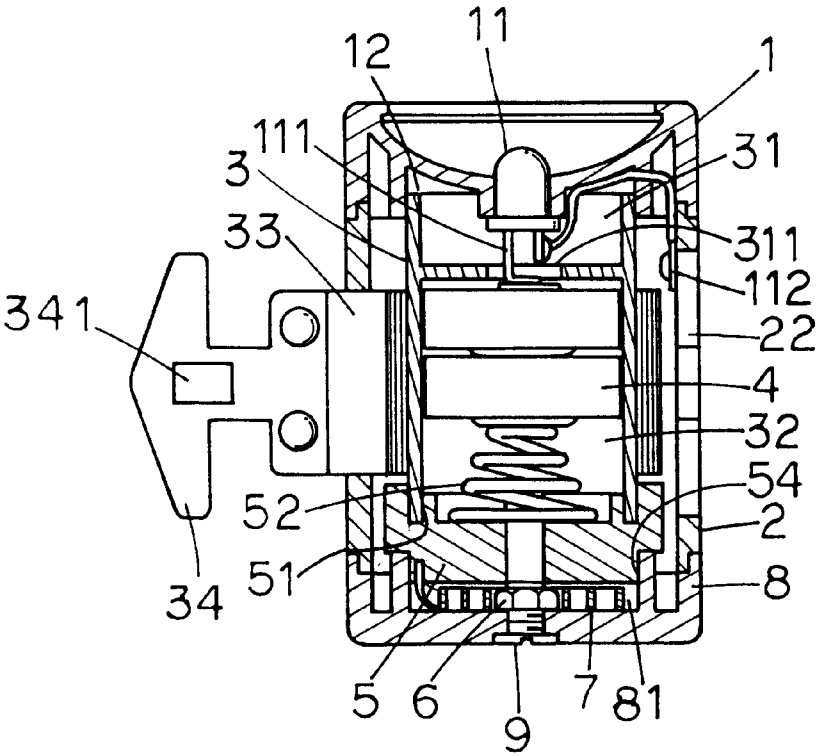
FIG. 3 is a sectional plan view of the present invention.

The rotary shaft mount 3 is also a hollow cylindrical structure having a recess 31 at a front end thereof. The bottom side of the recess 31 is provided with a central through hole 311. A battery chamber 32 FIG. 3 is disposed at one side of the through hole 311 opposite to the recess 31. The rotary shaft mount 3 further has a fastening band 33 of a determined length secured at and wound around its outer circumference. The outer end of the fastening band 33 has a metallic fastening plate 34 fixed thereon. The fastening plate 34 has a projecting elastic piece 341 disposed thereon.

The battery 4 is provided for supplying electricity to the present invention.

The movable shaft mount 5 is provided with an annular groove 51 at a front recess thereof. An electrically conductive spring 52 is secured in the annular groove 51. The movable shaft mount 5 has a shaft portion 54 of a slightly smaller diameter at a rear side thereof and a central shaft hole 53.

The reset spring 7 has a rear end fastened to a bottom side of the movable shaft mount 5 (see FIG. 3 as well) to facilitate resetting after rotation.

The rear cover 8 is provided with a shaft recess 81 of a slightly smaller diameter at an inner side thereof, and a central through hole 82 to facilitate passage of the spindle screw 9.

The spindle screw 9 has inner threads and a smooth outer surface to facilitate passage into the shaft hole 53 of the movable shaft mount to assist positioning.

The nut 6 is screwably locked to the inner threads of the spindle 9 to secure the central portion of the reset spring 7 on the through hole 82 in the shaft recess 81 of the rear cover 8.

With reference to FIGS. 2 and 3, during assembly of the present invention, the light source mount 1 is fitted tightly to the housing 2, with the negative conductive plate 112 secured in the plate securing groove 23. The front end of the rotary shaft mount 3, together with the battery 4 placed in the battery chamber 32, is fitted into the center of the housing 2 and into the shaft recess 12, while the positive conductive plate 111 of the light source module 11 passes through the through hole 311 to come into contact with the battery 4. The fastening plate 34 at the outer end of the fastening band 33 on the outer circumference of the rotary shaft mount 3 is passed through the elongate slot 21 to the outer side, while the elastic piece 341 on the fastening plate 34 is utilized to serve as a stop at the outer side of the elongate hole 21. The spindle screw 9 is then inserted into the through hole 82 of the rear cover 8, and the nut 6 is used to secure the central portion of the reset spring 7 at the bottom side of the shaft recess 81, while the shaft hole 53 of the movable shaft mount 5 made of metal is placed on a top end of the smooth portion of the spindle screw 9 for positioning purposes, such that the shaft portion 54 is located at an upper rim of the shaft recess 81. At this point, the light source mount 1, the housing 2, the rotary shaft 3, and the battery 4 are inter-fitted tightly so that the outer side of the bottom end of the rotary shaft mount 3 urges tightly against the annular groove 51 and the bottom end of the housing 2 urges tightly against the interior of the rear cover 8. Assembly of the present invention is then accomplished.

Figure 5:
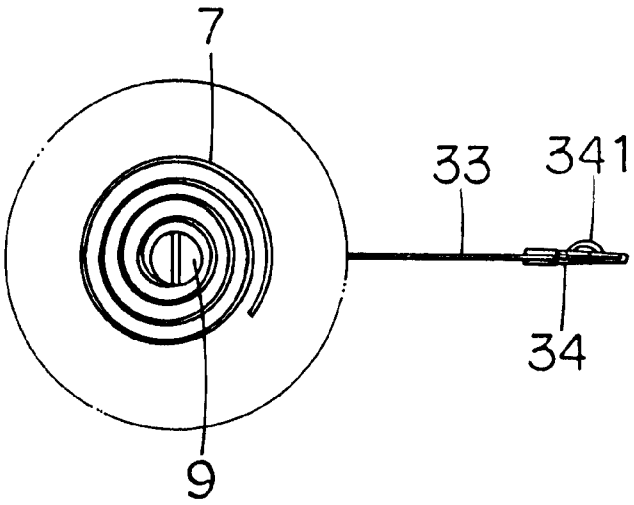
FIG. 5 is a perspective schematic view of the present invention after operation of the reset spring.
Figure 4:
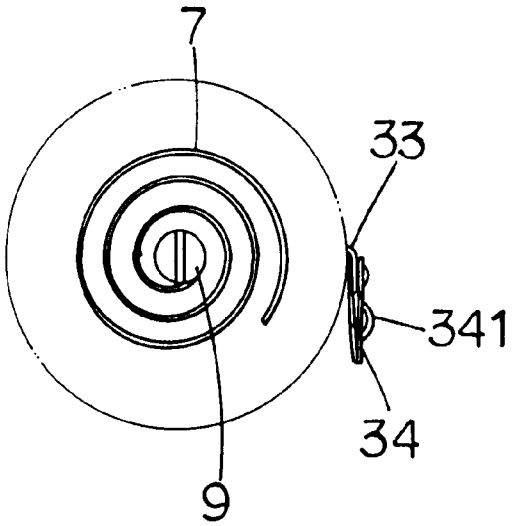
FIG. 4 is a perspective schematic view of the present invention prior to the operation of the reset spring.
Figure 6:
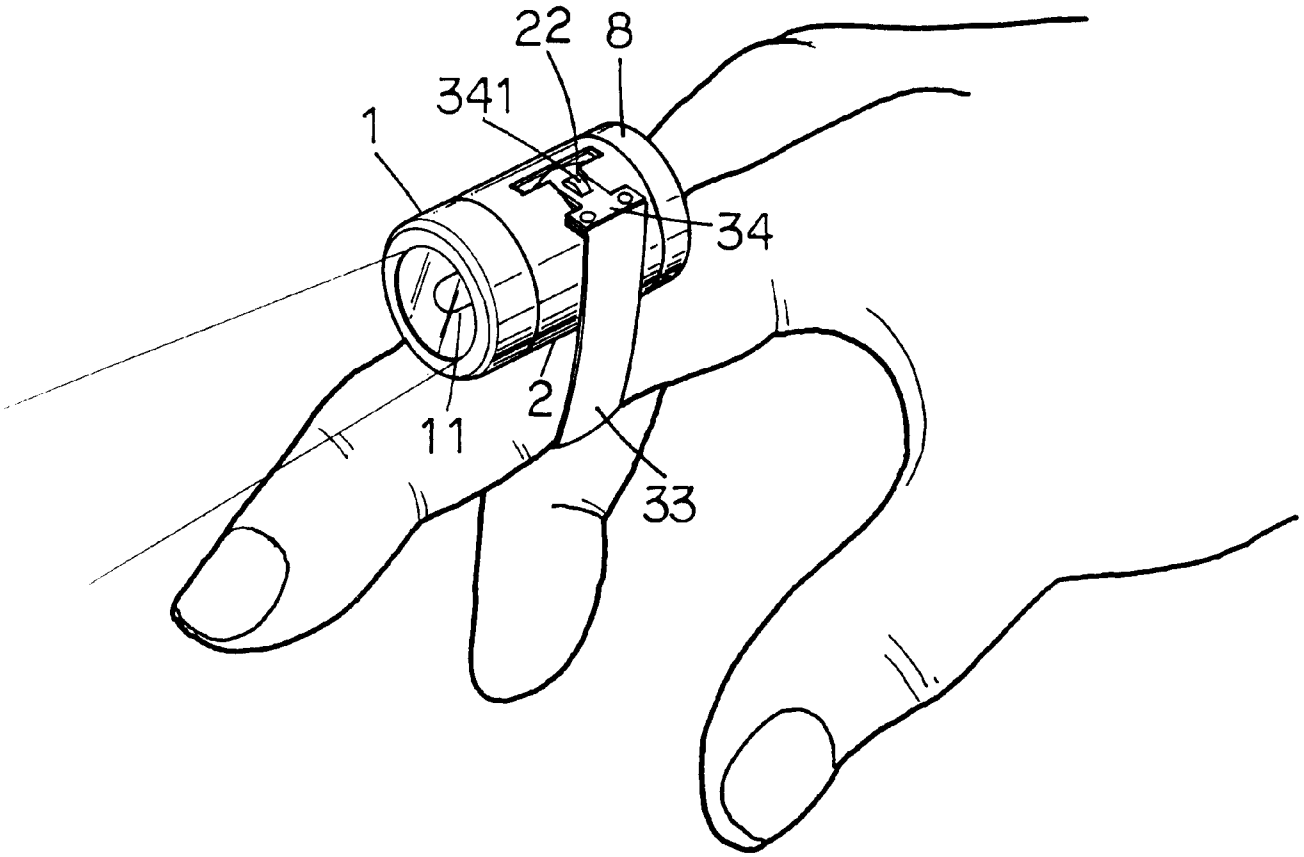
FIG. 6 illustrates an embodiment of the present invention in use.
Figure 7:
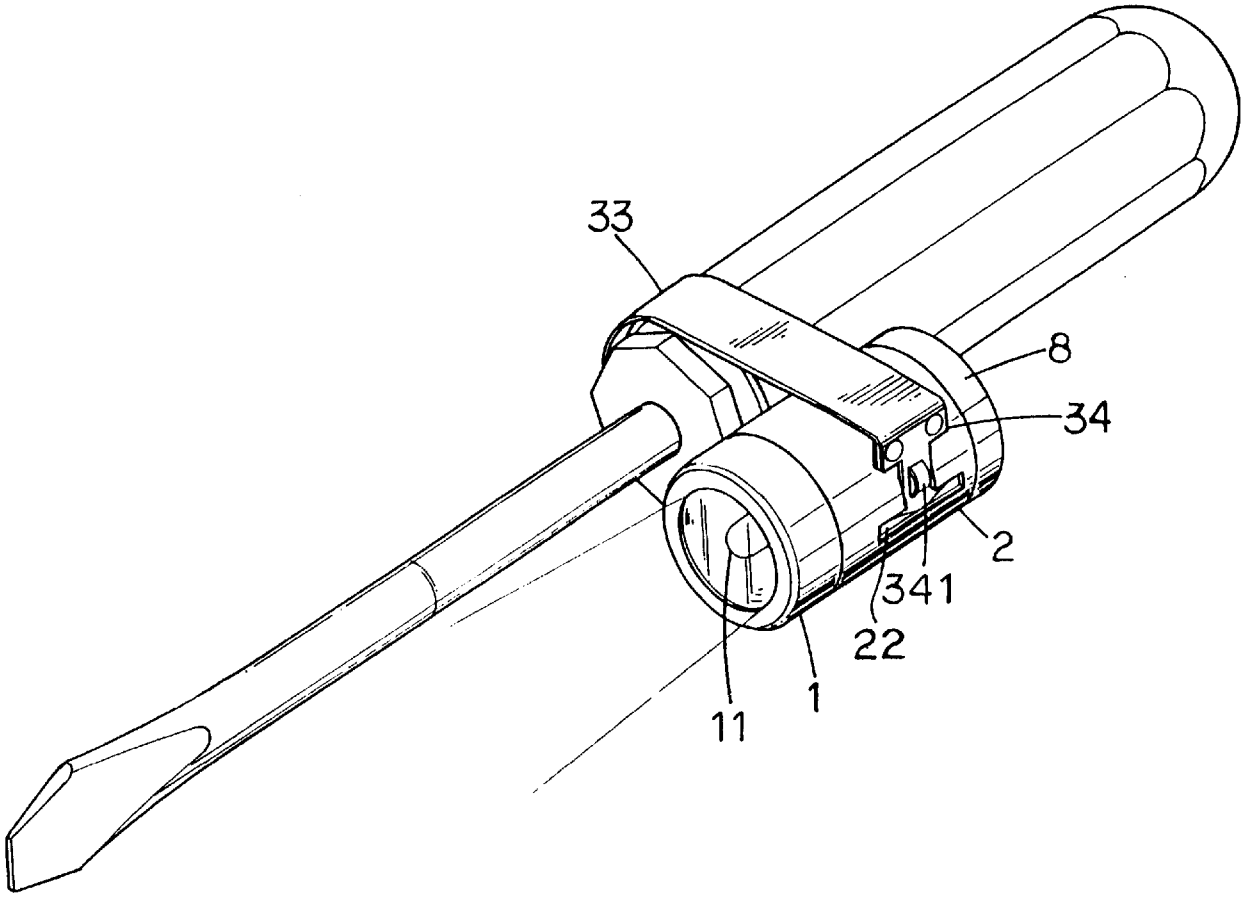
FIG. 7 illustrates another embodiment of the present invention in use.

Referring to FIGS. 3, 4 and 5, in use, the fastening plate 34 is utilized to pull out a desired length of the fastening band 33 so that the rotary shaft mount 3 will rotate therewith, synchronously bringing the movable shaft mount 5 below to turn in the shaft groove 81 of the rear cover so that the reset spring 7 at the lower end of the rotary shaft mount 3 is in a contracted state. With reference to FIGS. 6 and 7, when the fastening band 33 is wound around a finger of the user or a screwdriver and the fastening plate 34 is engaged with the fastening slot 22 of the housing 2 such that it is retained at the reduced portion of the fastening slot 22, the front end of the fastening plate 34 with a larger width may contact the metallic movable shaft mount 5 and the negative conductive plate 112, thereby electrically connecting in turn the movable shaft mount 5 and the electrically conductive spring 52, the battery 4, and the positive conductive plate 111 above, forming an electrical loop. Hence, electric power may be supplied to the light source module 11 for illumination or indication purposes. In view of the foregoing, it can be appreciated that the present invention has wide applications and is very convenient to use.

The fastening band 33 may be provided with a scale or graduations to enhance the added value of a commodity.

Although the present invention has been illustrated and described with reference to the preferred embodiment thereof, it should be understood that it is in no way limited to the details of such embodiment but is capable of numerous modifications within the scope of the appended claims.

What is claimed is:

1. An indicating device fastenable by means of a fastening band, comprising:

a housing;

a light source mount fitted to a front end of said housing in a tight fashion;

a rear cover fitted to a rear end of said housing in a tight fashion;

a reset spring secured at the center of an inner side of a shaft recess of said rear cover;

a movable shaft mount having a shaft portion disposed at an upper side of said rear cover;

an electrically conductive spring secured at a central portion of said movable shaft mount opposite to said shaft portion; and a rotary shaft mount formed with a battery chamber at a lower side thereof to receive at least one battery, a lower end of said battery pressing against said electrically conductive spring while an upper end thereof is in contact with a positive conductive plate of a light source module entering from a through hole in front, said rotary shaft mount being further provided with a fastening band thereon which passes through a through hole of said housing to the outer side, said fastening band having a metallic fastening plate at a front end thereof for securing purposes;

whereby when said fastening plate is pulled to pull out a desirable length of said fastening band, said rotary shaft mount will rotate therewith, causing said movable shaft mount fitted in said shaft recess of said rear cover to rotate so that said reset spring retracts, and when said fastening plate is fitted into a fastening slot of said housing, said metallic fastening plate will come into contact with said metallic movable shaft mount and a negative conductive plate, thereby electrically connecting said light source module for illumination purposes or for indicating a target object.

2. An indicating device as defined in claim 1, wherein said fastening band is provided with graduations or a scale.

3. An indicating device as defined in claim 1, wherein said reset spring is secured in said shaft recess using a spindle screw and a nut to assist positioning.

* * * * *